United States Patent [19]

Murray et al.

[11] Patent Number: 4,653,712

[45] Date of Patent: Mar. 31, 1987

[54] WINDOW SHELF BRACKETS

[76] Inventors: Robert B. Murray; Myrt L. Murray, both of 79 Martin Rd., Reading, Mass. 01867

[21] Appl. No.: 840,437

[22] Filed: Mar. 14, 1986

[51] Int. Cl.[4] ..... A47G 29/02

[52] U.S. Cl. ..... 248/236; 248/235

[58] Field of Search ..... 248/235, 236, 208, 243, 248/247; 211/90, 88, 87; 108/46; 47/40, 68

[56] References Cited

U.S. PATENT DOCUMENTS

| | | | |
|---|---|---|---|
| 324,291 | 8/1885 | Bennett | 211/90 X |
| 418,466 | 12/1889 | Jewett | 248/236 |
| 564,272 | 7/1896 | Cooper | 248/236 X |
| 883,001 | 3/1908 | Curtis | 211/90 X |
| 1,102,001 | 6/1914 | Cobourn | 248/208 |
| 1,283,029 | 10/1918 | Arntz | 248/236 |
| 2,152,990 | 4/1939 | Fader et al. | 211/90 X |
| 3,853,294 | 12/1974 | Albinson | 248/235 |
| 4,285,484 | 8/1981 | Follows | 248/235 |

FOREIGN PATENT DOCUMENTS

| | | | |
|---|---|---|---|
| 155268 | 7/1956 | Sweden | 248/235 |

*Primary Examiner*—J. Franklin Foss

[57] ABSTRACT

A shelf bracket is adapted to fit into a conventional window frame without tools or fasteners. The bracket may be a unitary piece of plastic.

1 Claim, 3 Drawing Figures

WINDOW SHELF BRACKETS

BACKGROUND OF THE INVENTION

This invention pertains to shelves and more particularly is concerned with brackets for installing shelves.

Shelves are common furnishings intended to hold decorative items such as ornamental plants and knick-nacks. Sometimes the preferred location of a shelf is in the opening of a window-frame, so that the supported items can receive light and be displayed to an advantage. It is possible to mount a shelf in a window by simply tacking strips of wood or like to the frame and extending a small board between the strips. This is not an ideal solution as some time and skill are required to install a shelf. Furthermore, holes are left upon removal of the shelf.

It is an object of this invention to provide brackets for supporting a shelf in the space of a window frame. It is also an object of the invention to provide shelf-supporting brackets which can be quickly installed and removed without tools and without the need of holes.

DETAILED DESCRIPTION OF THE INVENTION

Figure 1:
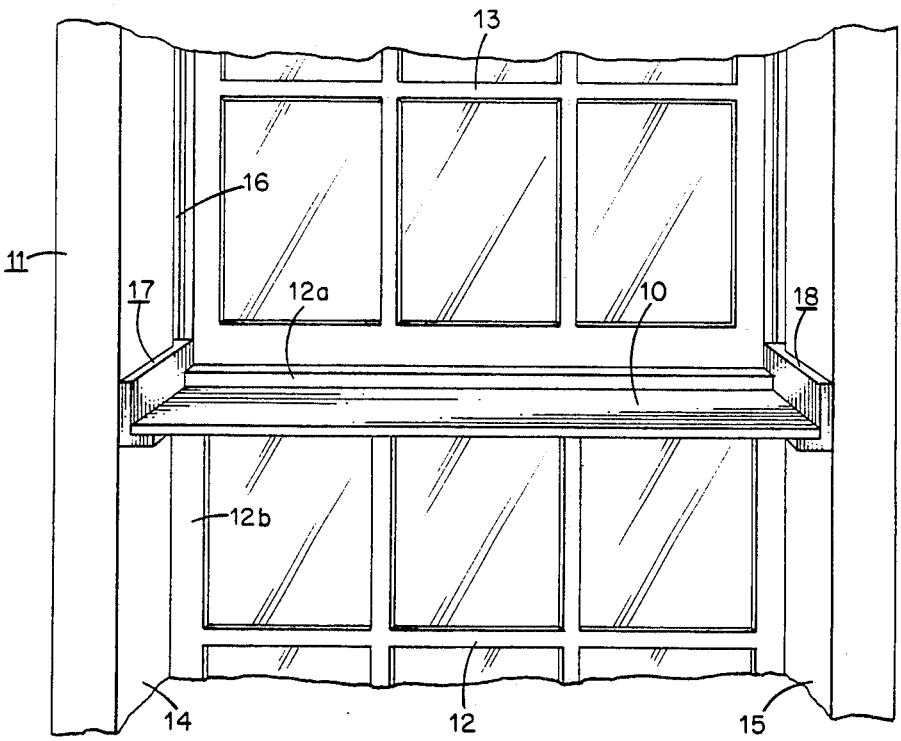
FIG. 1 shows a shelf mounted in a window with a pair of brackets embodying the invention.

Turning first to FIG. 1, there is seen a shelf mounted in a conventional window of the type having a rectangular frame 11 holding upper and lower sashes 12, 13 which can be moved up and down. Each of two vertical frame members 14, 15 has at least one groove 16 or track in which the sashes 12, 13 fit and slide. The bottom sash 12 normally is on the inner side of the frame 11. Shelf 10 is a wooden board or other flat member supported at its ends by a pair of brackets 17, 18, which embodies the invention.

Figure 2:
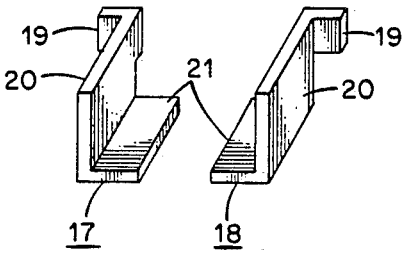
FIG. 2 illustrates in greater detail the brackets of FIG. 1.

In FIG. 2, the brackets 17, 18 are shown alone for clarity; however, the window elements of FIG. 1 will be referred to. Each bracket of a pair is a mirror image of the other. A bracket has three segments 19, 20, 21, with their largest area surfaces arranged to be mutually orthogonal. Preferably, each segment is a rectangular prism. A first segment 19 is dimensioned to have a portion fit inside the frame groove 16 and is attached to, and offset from, second segment 20. The portion of the first segment intended to fit in the groove is typically 0.250 inches thick and 0.375 inches long. When the bracket is installed, the bottom of first segment 19 rests against the top horizontal member **12*a* of the lower sash 12 and supports second segment 20 which rests against a vertical side 12*b* of sash 12. Third segment 21 is attached to, and extends from, the second segment 20**. When installed in a window, the third segments of a pair of brackets are at the same height and extend horizontally toward the center of the window for supporting in the ends of the shelf. No tools or fasteners are necessary to install the brackets.

The bottom of the first segment 19 and the top of the third segment 21 may be offset by the thickness of the shelf, so that top surface of the shelf 10 will be flush with horizontal member **21*a* of sash 12. FIG. 2** shows the shelf at a different level for clarity. This arrangement provides more surface area for items to be shelved. After installation of the shelf brackets, the bottom sash still may be moved up or down if so desired.

Figure 3:
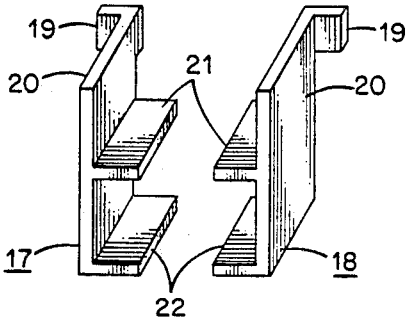
FIG. 3 represents a variation of the brackets.

As seen in FIG. 3, a bracket may have one or more additional segments 22 attached to second segment 20 parallel to the third segment 21, so that a corresponding number of additional shelves can be supported in the same window opening.

Preferably, each bracket is molded as a unitary piece of plastic. Wood, sheet metal, and other material are also suitable.

The best embodiment of the invention has been described. It will be apparent that various modifications can be made without departing the scope of the invention which is defined by the following claims.

We claim:

1. A pair of shelf brackets for installing on a window of the type having a grooved vertical frame member and a bottom sash, each of said brackets comprised of: at least three segments, including a first segment adapted for inserting in a groove in a vertical frame member of said window and resting upon a horizontal member of said bottom sash; a second segment attached to said first segment and orthogonal thereto, and adapted to rest against a vertical member of the sash when suspended from said first segment; and a third segment attached to said second segment and orthogonal to both the first and second segments and adapted to extend horizontally toward the center of said window, each of said brackets the mirror image of the other, so when mounted on opposite sides of said window, said third segments extend toward the center of the window and provide means for supporting the ends of a shelf, wherein the bottom of said first segment and the top of said third segment are offset by the thickness of said shelf, so that the top of said shelf is flush with the said horizontal member of said bottom sash.

* * * * *